US006382407B1

(12) United States Patent
Chao

(10) Patent No.: US 6,382,407 B1
(45) Date of Patent: May 7, 2002

(54) EYEGLASS CASE ADAPTED TO BE HUNG ON THE NECK OF THE USER

(76) Inventor: Richard Chao, 1120 Green Acre Rd., Towson, MD (US) 21204

( * ) Notice: Subject to any disclaimer, the term of this patent is extended or adjusted under 35 U.S.C. 154(b) by 8 days.

(21) Appl. No.: 09/708,875

(22) Filed: Nov. 8, 2000

(30) Foreign Application Priority Data

Sep. 22, 2000 (TW) ..... 089216484

(51) Int. Cl.[7] ..... A45C 11/04
(52) U.S. Cl. ..... 206/5; 24/3.4; 224/257
(58) Field of Search ..... 206/5; 24/3.8, 24/3.4; 224/257, 258; D3/219, 266

(56) References Cited

U.S. PATENT DOCUMENTS 4,744,461 A * 5/1988 Lapham ..... 206/5
5,423,419 A * 6/1995 Wentz et al. ..... 206/6
5,577,647 A * 11/1996 Pittarelli et al. ..... 215/228
6,170,651 B1 * 1/2001 Taormina ..... 206/229
D446,398 S * 8/2001 Zhou ..... D3/265

* cited by examiner

*Primary Examiner*—David T. Fidei
(74) *Attorney, Agent, or Firm*—Harness, Dickey & Pierce, P.L.C.

(57) ABSTRACT

An eyeglass case includes an annular sleeve, a tubular first housing, and a tubular second housing. The first housing has a closed end and an open end that is press-fitted to a first end portion of the sleeve in such a manner that the first housing can be removed forcibly from the sleeve. The second housing has a closed end and an open end that is attached to a second end portion of the sleeve, thereby defining an eyeglass-accommodating space between the first and second housings for accommodating a pair of eyeglasses. A hanging cord unit is fastened to the sleeve, and has a looped portion that can be hung on the neck of the user.

5 Claims, 5 Drawing Sheets

EYEGLASS CASE ADAPTED TO BE HUNG ON THE NECK OF THE USER

BACKGROUND OF THE INVENTION

1. Field of the Invention

The invention relates to an eyeglass case, more particularly to an eyeglass case which is adapted to be hung on the neck of the user.

2. Description of the Related Art

Referring to FIG. 1, a conventional eyeglass case 1 is shown to include a tubular first housing 11, a tubular second housing 12 and a hanging cord unit 14. The tubular first housing 11 has a closed end which is formed with a pair of cord holes 13, and an open end 16 that is press-fitted to an open end of the tubular second housing 12, thereby defining an eyeglass-accommodating space between the first and second housings 11,12, which is adapted to receive a pair of eyeglasses (not visible). The hanging cord unit 14 extends through the cord holes 13 of the tubular first housing 11 so as to be fastened thereto, and has a looped portion exposed outwardly of the eyeglass case 1 such that the looped portion is adapted to be sleeved on the neck of the user.

Some disadvantages that result from the use of the aforesaid conventional eyeglass case 1 are as follows:

(i) The first and second housings 11,12 are press-fitted to each other. Since the eyeglass case 1 dangles vertically when the cord unit 14 is hung around the neck of the user, the weight of the eyeglasses is concentrated wholly on the second housing 12 such that the second housing 12 may loosen and drop from the first housing 11 after long term use.

(ii) In. the event that the user of the aforesaid conventional eyeglass case 1 bends his upper body part forward, such as in the act of picking up something, so as to bring the chest and stomach toward each other, the upper and lower parts of the eyeglass case 1 will be pinched between the chest and stomach of the user, thereby resulting in discomfort to the user.

SUMMARY OF THE INVENTION

Therefore, the main object of this invention is to provide an eyeglass case which is adapted to be hung on the neck of the user and which includes a first housing and a second housing that does not easily separate from the first housing.

A second object of the present invention is to provide an eyeglass case which dangles horizontally or inclinedly relative to a vertical direction when the eyeglass case is hung over the neck of the user by the use of a cord unit so as to avoid the possibility of the eyeglass case colliding the chest or stomach of the user in case the user bends forward his upper body part.

Accordingly, an eyeglass case of the present invention includes a sleeve, a tubular first housing, a tubular second housing, and a hanging cord unit. The sleeve is shaped as an annular plate, and has a first end portion and a second end portion. The tubular first housing has a closed end and an open end that is press-fitted to the first end portion of the sleeve in such a manner that the first housing can be removed forcibly from the sleeve. The tubular second housing has a closed end and an open end that is attached to the second end portion of the sleeve, thereby defining an eyeglass-accommodating space between the first and second housings, which is adapted to receive a pair of eyeglasses therein. The hanging cord unit is fastened to the sleeve, and has a looped portion that is adapted to be sleeved on the neck of the user.

When hung on the user's neck, the eyeglass case of the present invention extends horizontally or inclinedly relative to a vertical direction such that the weight of the pair of eyeglasses contained therein is not wholly concentrated on either of the first and second housings. Thus, untimely disengagement between the first and second housings is prevented. In addition, collision of the eyeglass case against the user's chest or stomach can be avoided by virtue of the horizontal or inclined orientation of the eyeglass case.

BRIEF DESCRIPTION OF THE DRAWINGS

Other features and advantages of this invention will become more apparent in the following detailed description of preferred embodiments of this invention, with reference to the accompanying drawings, in which.

DETAILED DESCRIPTION OF THE PREFERRED EMBODIMENTS

Figure 1:
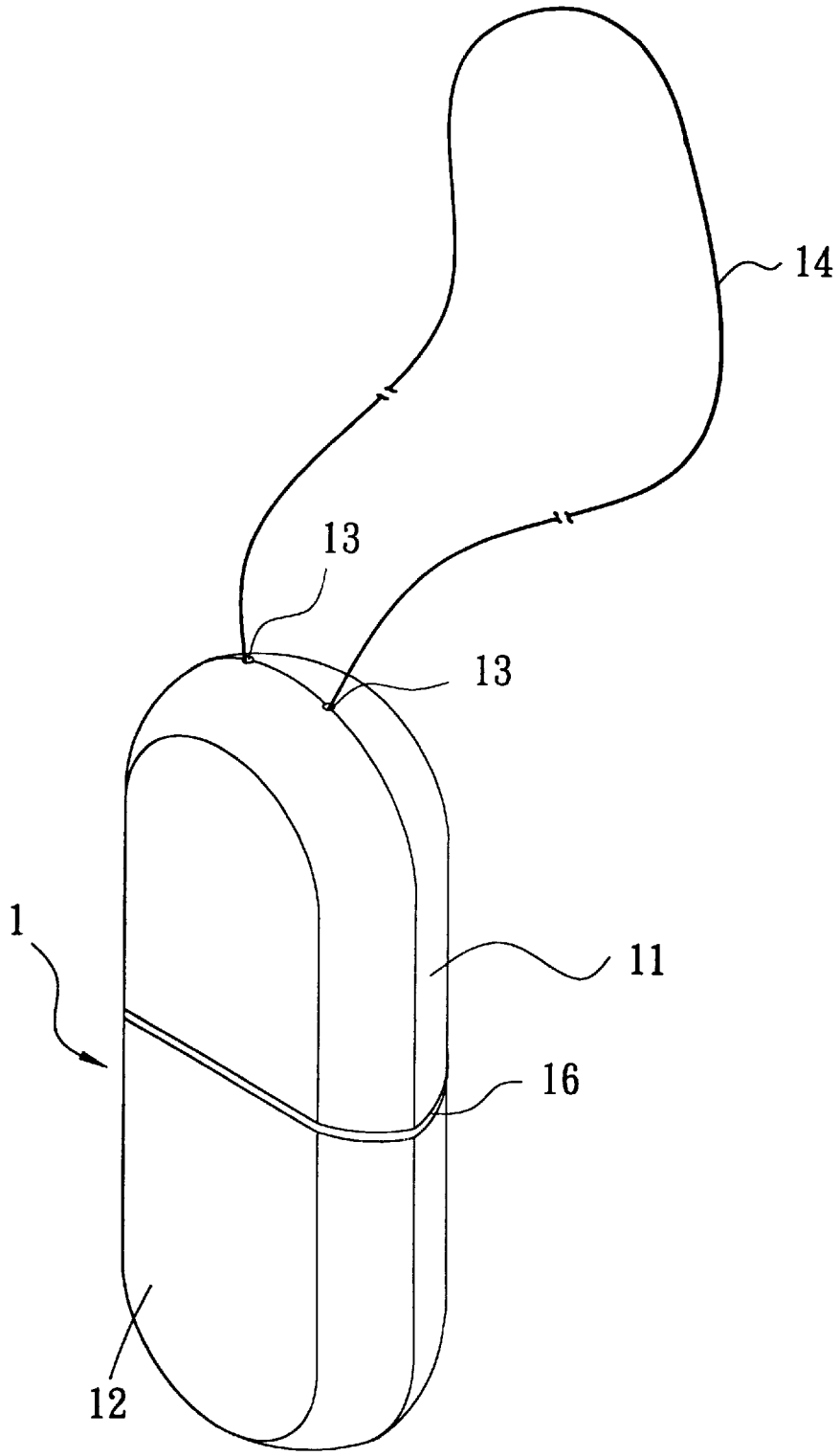
FIG. 1 PRIOR ART
FIG. 1 is a schematic side view of a conventional eyeglass case.
Figure 2:
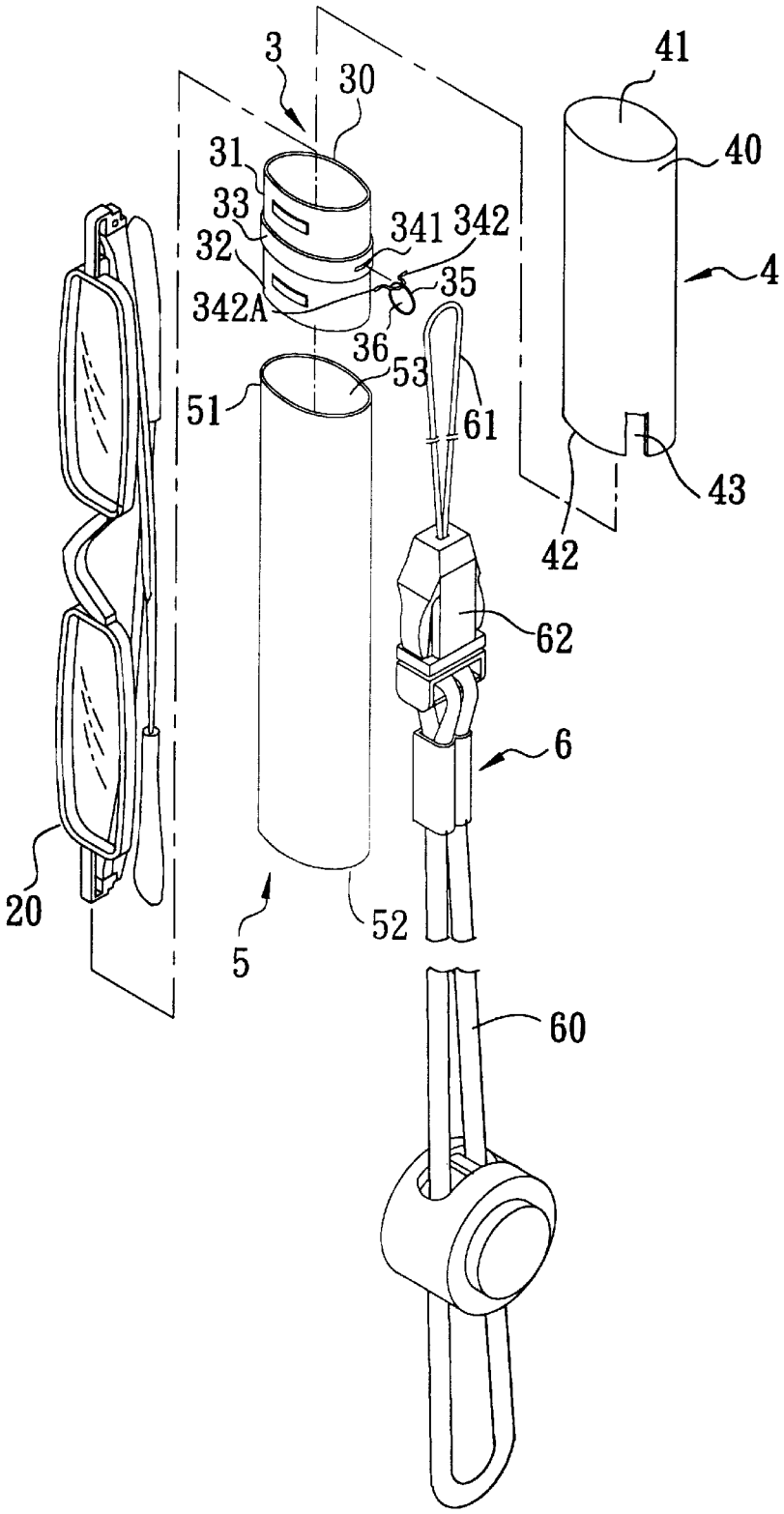
FIG. 2 is an exploded view of a preferred embodiment of an eyeglass case according to the present invention.
Figure 3:
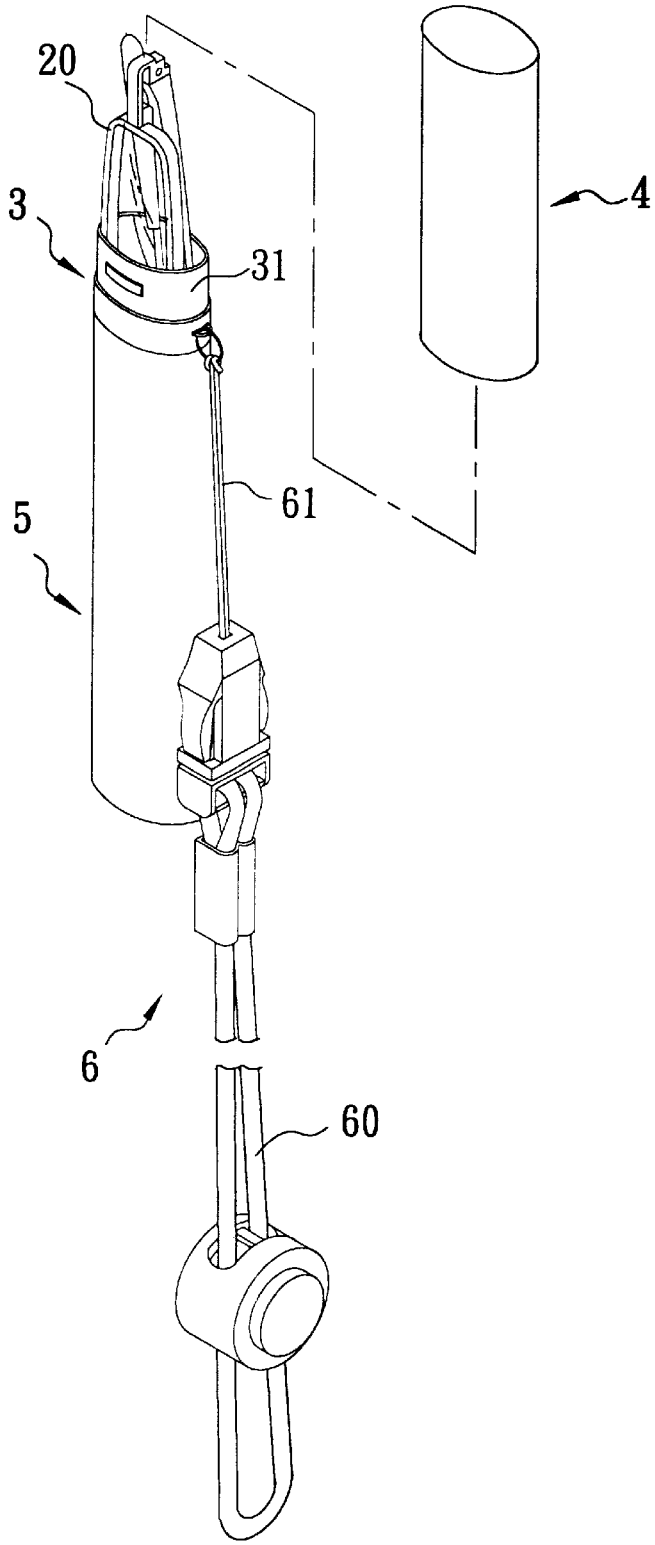
FIG. 3 is a perspective side view of the preferred embodiment, wherein a first housing is removed from a second housing so as to illustrate how a pair of eyeglasses is retained in the second housing.
Figure 4:
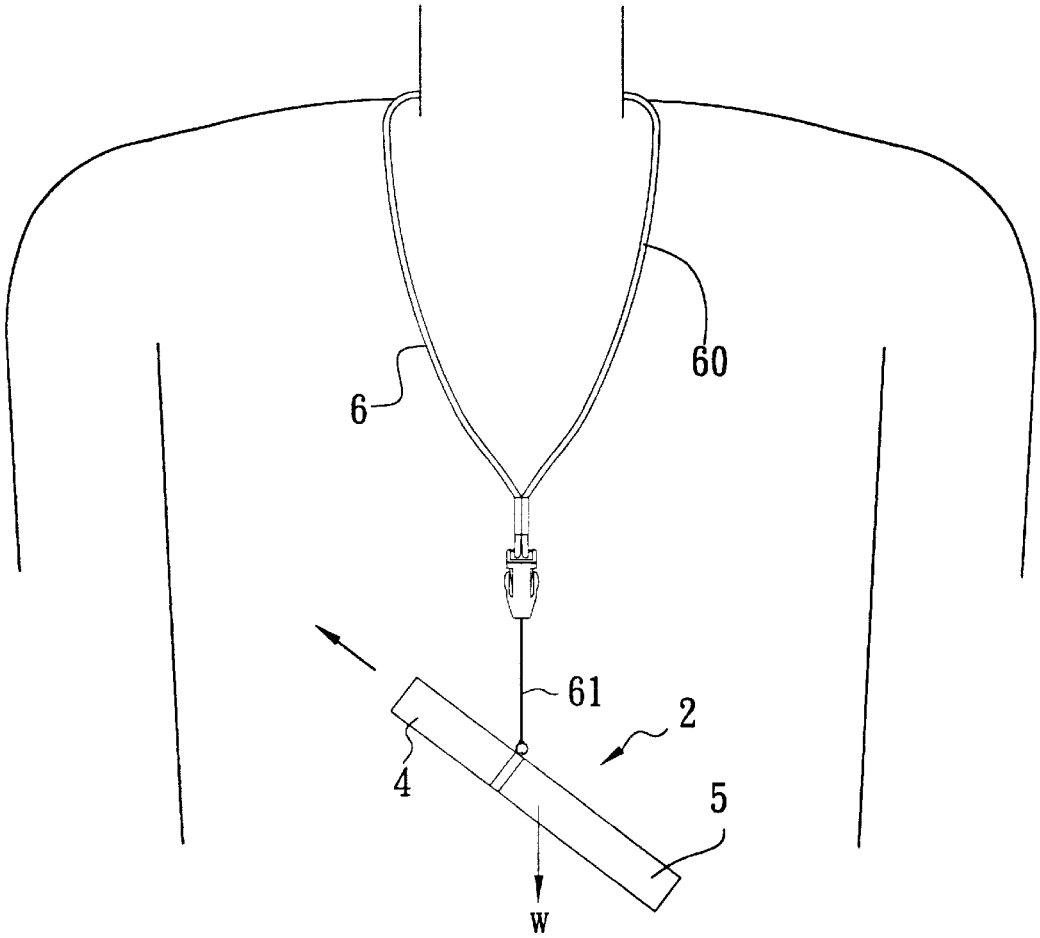
FIG. 4 is a view of the preferred embodiment when hung on the neck of the user.

Referring to FIGS. 2 to 4, a preferred embodiment of an eyeglass case according to the present invention is shown to include a tubular sleeve 3, a tubular second housing 4, a tubular second housing 5 and a hanging cord unit 6.

As illustrated, the sleeve 3 is shaped as an annular plate, and has a first end portion 31 and a second end portion 32.

The tubular first housing 4 has a closed end 41 and an open end 42 that is press-fitted onto the first end portion 31 of the sleeve 3 in such a manner that the first housing 4 can be removed forcibly from the sleeve 3.

The tubular second housing 5 has a closed end 52 and an open end 51 that is attached to the second end portion 32 of the sleeve 3, thereby defining an eyeglass-accommodating space (43+53) between the first and second housings 4,5, which is adapted to receive a pair of eyeglasses 20 therein.

The hanging cord unit 6 has a first looped portion 61 fastened to the sleeve 3, and a second looped portion 60 that is adapted to be sleeved on the neck of the user. The first and second looped portions 61,60 are coupled to each other by a conventional cord connector 62.

Preferably, the open end 51 of the second housing 5 is press fitted onto the second end portion 32 of the sleeve 3. Alternatively, the open end 51 of the second housing 5 can be formed integrally with the second end portion 32 of the sleeve 3.

In the preferred embodiment, the sleeve 3 includes a sleeve body 30, a generally U-shaped retaining member 342, and a ring 35. An annular ring 33 is formed integrally on an outer surface of the sleeve body 30 so as to define the first and second end portions 31,32 on two sides of the ring 33. The sleeve body 30 is further formed with a slot 341 which extends through the ring 33 and which has two closed ends. The retaining member 342 extends through the slot 341 in the sleeve body 30, and has two ends, which are disposed within the sleeve body 30 and which are formed respectively with two integral insert arms 342A that extend outwardly away from each other and that are sized so as to prevent outward removal of the retaining member 342 from the sleeve body 30 via the slot 341. The ring 35 is sleeved on the retaining member 342, and is disposed outside of the sleeve body 30. The cord unit 6 is fastened onto the ring 35. Under this condition, when the cord unit 6 is hung on the neck of the user, the eyeglass case 2 extends in an inclined direction with respect to a vertical direction (W) that is parallel to the first looped portion 61 of the cord unit 6. Thus, the possibility of the eyeglass case 2 colliding the user's chest or stomach during forward bending can be avoided. Moreover, the second housing 5 will not easily separate from the first housing 4, since the weight of the eyeglass case 2 is more or less distributed between the first and second housings 4, 5. Althrough the case 2 is inclined when hung on the neck of the user in this embodiment, it may have a horizontal orientation. Under this condition, the objects of this invention as stated hereinabove can also be achieved.

Figure 5:
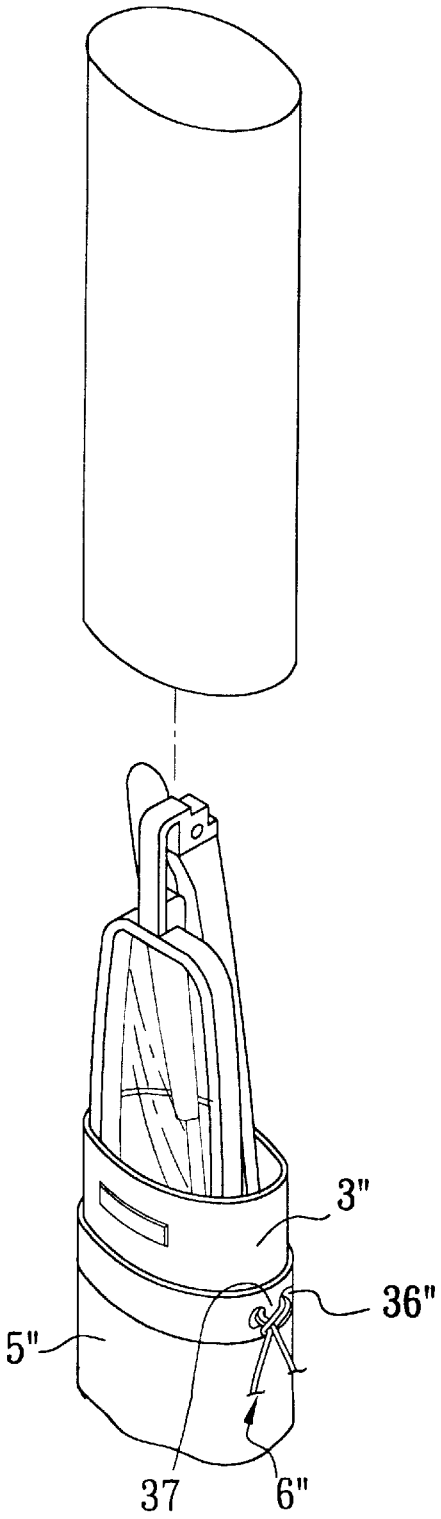
FIG. 5 is a fragmentary perspective view of a modified preferred embodiment of the present invention.

Referring to FIG. 5, a modified preferred embodiment of the present invention is shown to have a structure similar to that of the previous embodiment, except that the sleeve 3" is integrally formed with the second housing 5". The sleeve 3" is further formed with an adjacent pair of holes 36" therethrough, which define a spacer sheet 37 therebetween. The cord unit 6" extends through the holes 36" in the sleeve 3", and is fastened to the spacer sheet 37.

With this invention thus explained, it is apparent that numerous modifications and variations can be made without departing from the scope and spirit of this invention. It is therefore intended that this invention be limited only as indicated in the appended claims.

I claim:

1. An eyeglass case comprising:

a sleeve shaped as an annular plate, and having a first end portion and a second end portion;

a tubular first housing having a closed end and an open end that is press-fitted to said first end portion of said sleeve in such a manner that said first housing can be removed forcibly from said sleeve;

a tubular second housing having a closed end and an open end that is attached to said second end portion of said sleeve, thereby defining an eyeglass accommodating space between said first and second housings which is adapted to receive a pair of eyeglasses; and a hanging cord unit fastened to said sleeve, and having a looped portion that is adapted to be sleeved on a neck of a user.

2. The eyeglass case as defined in claim 1, wherein said open end of said second housing is press-fitted to said second end portion of said sleeve.

3. The eyeglass case as defined in claim 2, wherein said sleeve includes:

a sleeve body formed with a slot therethrough, said slot having two closed ends;

a generally U-shaped retaining member extending through said slot in said sleeve body, and having two ends, which are disposed within said sleeve body and which are formed respectively with two integral insert arms that extend outwardly away from each other and that are sized so as to prevent outward removal of said retaining member from said sleeve body via said slot; and a ring sleeved on said retaining member and disposed outside of said sleeve body, said cord unit being fastened onto said ring.

4. The eyeglass case as defined in claim 1, wherein said open end of said second housing is formed integrally with said second end portion of said sleeve.

5. The eyeglass case as defined in claim 1, wherein said sleeve is formed with an adjacent pair of holes therethrough, which define a spacer sheet therebetween, said cord unit extending through said holes in said sleeve and being fastened to said spacer sheet.

* * * * *